US008045873B2

(12) United States Patent
Kobayashi

(10) Patent No.: US 8,045,873 B2
(45) Date of Patent: Oct. 25, 2011

(54) IMAGE FORMING APPARATUS AND IMAGE DENSITY ADJUSTING METHOD

(75) Inventor: Kazumi Kobayashi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 573 days.

(21) Appl. No.: 12/219,986

(22) Filed: Jul. 31, 2008

(65) Prior Publication Data

US 2009/0035029 A1 Feb. 5, 2009

(30) Foreign Application Priority Data

Aug. 2, 2007 (JP) ..... 2007-202352
Jun. 23, 2008 (JP) ..... 2008-163346

(51) Int. Cl.
*G03G 15/00* (2006.01)
*G03G 15/01* (2006.01)

(52) U.S. Cl. ..... 399/49; 399/298

(58) Field of Classification Search ..... 399/49, 399/298

See application file for complete search history.

(56) References Cited

U.S. PATENT DOCUMENTS

| | | | | |
|---|---|---|---|---|
| 6,108,510 | A * | 8/2000 | Nakane | 399/303 |
| 6,334,039 | B1 * | 12/2001 | Yoshinaga et al. | 399/298 |
| 6,385,427 | B1 * | 5/2002 | Nakane | 399/303 |
| 7,778,560 | B2 * | 8/2010 | Ishibashi et al. | 399/50 |
| 2003/0164955 | A1 * | 9/2003 | Vinas et al. | 358/1.2 |
| 2007/0047981 | A1 * | 3/2007 | Ishida | 399/27 |

FOREIGN PATENT DOCUMENTS

| | | | |
|---|---|---|---|
| JP | 09326942 | A * | 12/1997 |
| JP | 11133700 | A * | 5/1999 |
| JP | 2005017396 | A * | 1/2005 |

* cited by examiner

*Primary Examiner* — David Gray
*Assistant Examiner* — Francis Gray
(74) *Attorney, Agent, or Firm* — Harness, Dickey & Pierce, P.L.C.

(57) ABSTRACT

In an image forming apparatus, when photosensitive members 4Y, 4M, 4C are in contact with a transfer belt, then color adjustment is performed. When the photosensitive members 4Y, 4M, 4C are not in contact with a transfer belt, i.e., only a photosensitive member 4Bk is in contact with the transfer belt, then only black adjustment is performed.

13 Claims, 9 Drawing Sheets

BLACK ADJUSTMENT PATTERN

COLOR ADJUSTMENT PATTERN

ADJUSTMENT FORMATION OF FOUR COLORS

ADJUSTMENT PATTERN OF FOUR COLORS

IMAGE FORMING APPARATUS AND IMAGE DENSITY ADJUSTING METHOD

CROSS-REFERENCE TO RELATED APPLICATIONS

The present application claims priority to and incorporates by reference the entire contents of Japanese priority document 2007-202352 filed in Japan on Aug. 2, 2007 and Japanese priority document 2008-163346 filed in Japan on Jun. 23, 2008.

BACKGROUND OF THE INVENTION

1. Field of the Invention

The present invention relates to an image forming apparatus and an image density adjusting method.

2. Description of the Related Art

A typical color image forming apparatus, such as a tandem-type electrophotographic image forming apparatus, has both a monochrome mode and a color mode. Japanese Patent Application Laid-open No. H7-66953 discloses a color image forming apparatus in which only a black and white (B&W) image is formed in the monochrome mode to prolong the life of image carriers, and a full color image is formed in the color mode by superimposing a plurality of color images.

Such an image forming apparatus having the monochrome mode and the color mode generally includes an image quality adjusting unit that forms a pattern of image patches (adjustment patches), reads the density of the pattern using a sensor, and performs a feedback control based on the density of the pattern read by the sensor to optimize the image quality. In a conventional image forming apparatus that includes a plurality of image forming units corresponding to, for example, yellow (Y), magenta (M), cyan (C), and black (Bk), the density of all the four colors, including black, is adjusted at a time.

A color image is not formed in the monochrome mode. Therefore, if the color adjustment is necessary and if the current mode is the monochrome mode, the printing mode must be switched to the color mode. The time for switching the printing mode causes a waiting time to a user, which can be annoying.

Some image forming apparatuses are configured not to perform the color adjustment in the monochrome mode even when the color adjustment is required. In such image forming apparatuses, however, sudden switching of the printing mode from the monochrome mode to the color mode accompanies a color adjustment, and the user has to wait until the color adjustment is completed.

In the image forming apparatus disclosed in Japanese Patent Application Laid-open No. H7-66953, a correction pattern is formed on a transfer medium and a color misalignment is corrected using the correction pattern. However, it cannot be said that the color adjustment is performed considering the problem of switching the printing mode between the monochrome mode and the color mode.

SUMMARY OF THE INVENTION

It is an object of the present invention to at least partially solve the problems in the conventional technology.

According to an aspect of the present invention, there is provided an image forming apparatus for forming an image by superimposing a plurality of single-color images on a recording medium. The image forming apparatus includes an image carrier configured to carry an image; an image forming unit that is configured to form an image on the image carrier with predetermined density and transfers the image onto the recording medium, wherein the image forming unit forms a first pattern of black with a plurality of density levels and a second pattern of a plurality of colors other than black with a plurality of density levels on the image carrier; a pattern detecting unit that detects the first pattern and the second pattern formed on the image carrier; a first adjusting unit that performs a first adjustment of adjusting density of black based on the first pattern detected by the pattern detecting unit when the image forming unit is to form an image that is to be transferred on the recording medium; a second adjusting unit that performs a second adjustment of adjusting density of colors other than black based on the second pattern detected by the pattern detecting unit when the image forming unit is to form an image that is to be transferred onto the recording medium; and a determining unit that determines whether to perform the first adjustment or to perform the second adjustment based on a type of the image to be formed on the recording medium.

According to still an aspect of the present invention, there is provided a method of adjusting density of an image that is formed by superimposing a plurality of single-color images on a recording medium. The method includes forming a first pattern of black with a plurality of density levels and a second pattern of a plurality of colors other than black with a plurality of density levels on an image carrier; detecting the first pattern and the second pattern formed on the image carrier; first adjusting including performing a first adjustment of adjusting density of black based on the first pattern detected at the detecting when forming an image that is to be transferred onto the recording medium; second adjusting including performing a second adjustment of adjusting density of the colors other than black based on the second pattern detected at the detecting when forming an image that is to be transferred on the recording medium; and determining whether to perform the first adjustment or the second adjustment based on a type of an image to be formed on the recording medium, wherein when it is determined at the determining to perform the first adjustment, the first pattern is formed on the image carrier, and when it is determined at the determining to perform the second adjustment, the second pattern is formed on the image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. Image forming apparatuses according to the embodiments are adapted for a tandem-type electrophotographic printer (hereinafter, "printer"). Alternatively, for example, the image forming apparatuses can be adapted for a copier capable of printing a monochrome (B&K) image as well as a color image, or a multifunction peripheral (MFP) that has functions of, for example, copying, facsimileing, and printing. The image forming apparatus forms a color image by superimposing images of Y, M, C, and Bk. Alternatively, the image forming apparatus can be configured to form a color image by superimposing images of a plurality of colors other than Bk.

A printer 100 according to a first embodiment of the present invention prints a color image by superimposing a plurality of color images formed with corresponding color toners and a monochrome image using black toner.

Figure 1:
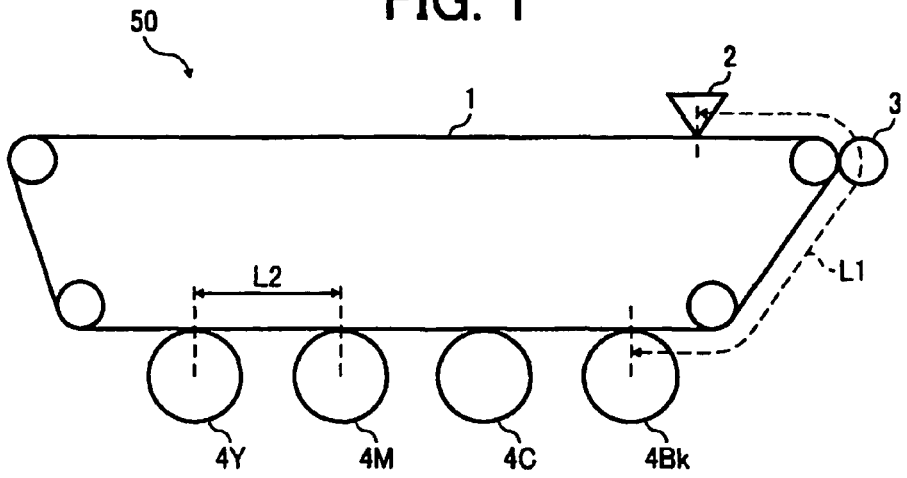
FIG. 1 is a schematic diagram of an image forming unit of an image forming apparatus according to a first embodiment of the present invention.

FIG. 1 is a schematic diagram of an image forming unit 50 of the printer 100. The image forming unit 50 includes four photosensitive members 4Y, 4M, 4C, and 4Bk that are regularly arranged along a transfer belt 1, a secondary transfer unit 3, and a pattern detecting sensor 2. The printer 100 prints a monochrome image using Bk and a color image using Y, C, M, and Bk.

The photosensitive member 4Bk transfers a Bk toner image with predetermined density onto the transfer belt 1, thereby forming a monochrome image. The photosensitive members 4Y, 4M, 4C, and 4Bk transfer Y, M, C, and Bk toner images with predetermined density onto the transfer belt 1 in a superimposing manner, respectively, thereby forming a color image.

The photosensitive member 4Bk forms, on the transfer belt 1, a Bk adjustment pattern of a plurality of adjustment patches of Bk with different density levels that are arranged in a line. The photosensitive members 4Y, 4M, and 4C form, on the transfer belt 1, a color adjustment pattern including Y, M, and C adjustment patterns each of which includes adjustment patches of each color with different density levels. The Bk adjustment pattern and the color adjustment pattern are collectively referred to as "an adjustment pattern".

The pattern detecting sensor 2 emits a light on the transfer belt 1 at a timing when the Bk adjustment pattern and the color adjustment pattern pass under the pattern detecting sensor 2 and receives the light reflected on the transfer belt 1, thereby detecting the adjustment pattern. Based on the result of detecting the adjustment pattern, a feedback control is performed to adjust the image density of each color. Therefore, an image with appropriate density can be printed. The feedback control can be performed for, a transfer bias, a developing/charging bias, some other single physical parameters, or a combination of a plurality of physical parameters.

A recording medium is fed from a feeding cassette (not shown) and the secondary transfer unit 3 transfers a toner image formed on the transfer belt 1 onto the recording medium.

L1 shown in FIG. 1 is a distance from a position at which the photosensitive member 4Bk forms the Bk adjustment pattern to a position at which the pattern detecting sensor 2 detects the adjustment pattern, and L2 is a distance between adjacent photosensitive members.

Figure 2:
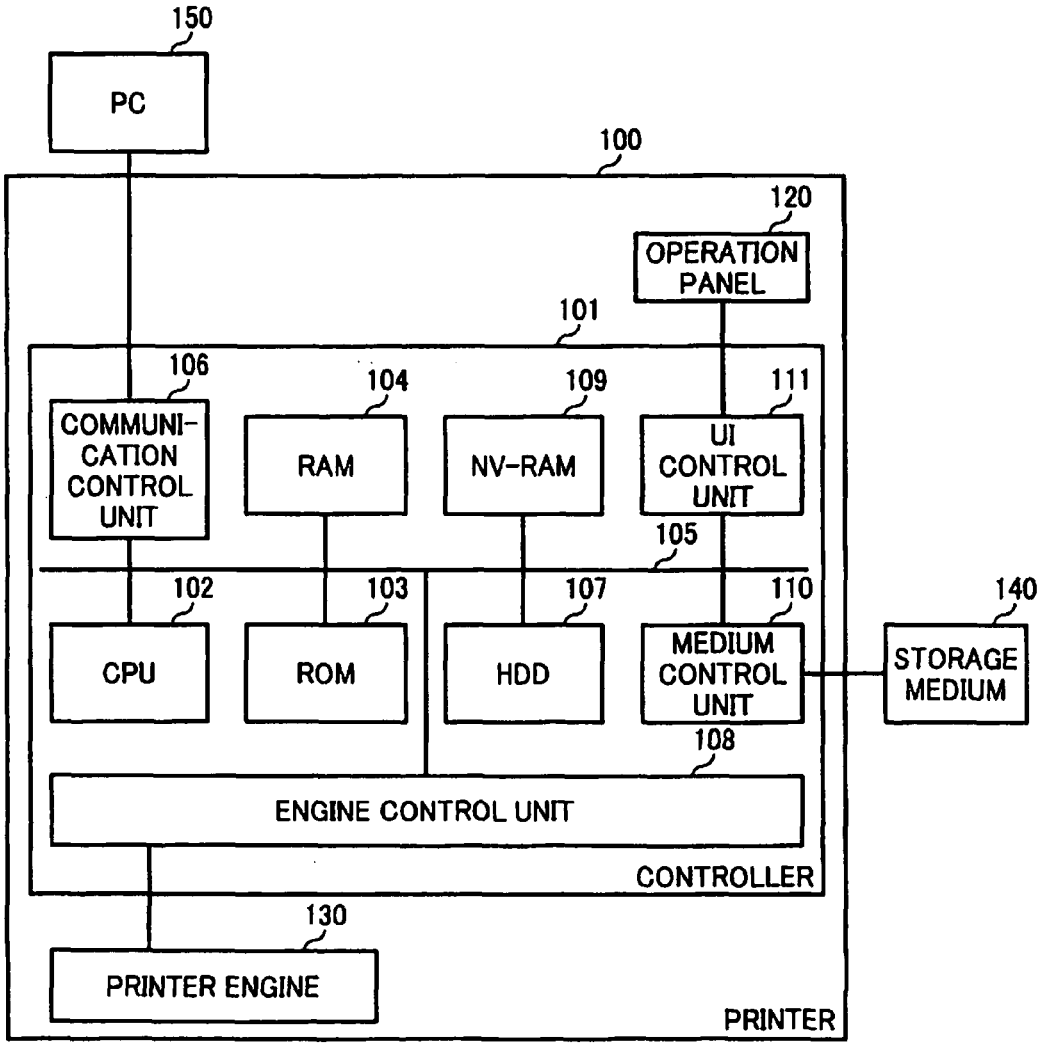
FIG. 2 is a block diagram of the image forming apparatus according to the first embodiment.

FIG. 2 is a block diagram of the printer 100. The printer 100 includes a controller 101 that performs various types of controls including controlling each unit of the printer 100 and an image forming process (a printing process). An operation panel 120 and a printer engine 130 are connected to the controller 101.

The operation panel 120 receives instructions given by a user by selecting items displayed thereon and displays information about a status of the printer 100, a printing mode, and a user interface (UI) for changing printing conditions.

The printer engine 130 includes the image forming unit 50, and it forms an image by an electrophotographic system and forms a monochrome image or a color image on a recording medium fed from the feeding tray.

The controller 101 converts data to be printed into a drawing data and outputs the drawing data to the printer engine 130.

The controller 101 includes a central processing unit (CPU) 102 that controls the printer 100. The controller 101 includes a read only memory (ROM) 103 that stores therein computer programs executed by the CPU 102 and necessary data and a random access memory (RAM) 104 for configuring a work area of the CPU 102, and these units are connected to the CPU 102 via an internal bus 105. The RAM 104 is used as a buffer for managing the data to be printed on a page basis and storing the data and as a bit map memory for converting the data stored in the buffer into an actual drawing image and storing video data.

The controller 101 also includes a communication control unit 106, a hard disk drive (HDD) 107, an engine control unit 108, a nonvolatile random access memory (NV-RAM) 109, a medium control unit 110, and an UI control unit 111, and these units are connected to the CPU 102 via the internal bus 105 and data is communicated therebetween via mainly the internal bus 105.

The NV-RAM 109 maintains stored information used for control by the CPU 102 regardless of a state of supplying power.

The UI control unit 111 is connected to the operation panel 120 and communicates data with the UI that is displayed on the operation panel 120.

The communication control unit 106 is an interface card, which is incorporated in the printer 100, for connecting the printer 100 to, for example, a local area network (LAN) cable and a universal serial bus (USB) cable. For example, the communication control unit 106 connects a personal computer (PC) 150, which is an external device, to the printer 100 via the LAN cable, and it receives data to be printed from the PC 150 and transmits printing result information to the PC 150.

The HDD 107 stores therein various types of print information and saves therein appropriate information files other than the print information. The HDD 107 also stores therein an operating system (OS) and various types of application programs, including a printing process program, executed on the OS.

The engine control unit 108 is an interface for transmitting a control signal from the CPU 102 to the printer engine 130 and for receiving an engine status signal from the printer engine 130 to the CPU 102.

The medium control unit 110 is an interface or an insertion slot for a nonvolatile storage medium 140 that is a removable external recording medium such as a secure digital (SD) card. Whether the storage medium 140 is inserted to the insertion slot can be determined based on voltage variations occurring on the insertion of the storage medium 140 (i.e., hot swap).

When the user turns on the power supply of the printer 100, the OS is read from the HDD 107 to the RAM 104 and the OS is booted. Thereafter, the OS starts the application programs, reads information, or stores information depending on operations by the user. The application programs are not limited to application programs that can be executed by a predetermined OS. In other words, the application programs can include an application program for causing the OS to execute a part of the various types of processing explained below and an application program that is contained in a series of program files constituting a predetermined application program, the OS, and the like.

Figure 3:
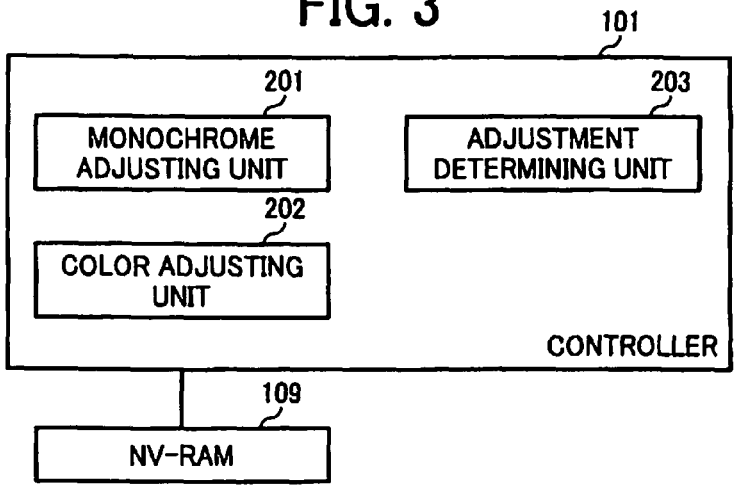
FIG. 3 is a functional block diagram of a controller of the image forming apparatus according to the first embodiment.

Control by the controller 101 is explained below. FIG. 3 is a functional block diagram of the controller 101. The controller 101 includes a monochrome adjusting unit 201, a color adjusting unit 202, and an adjustment determining unit 203. The NV-RAM 109 is connected to the controller 101. The NV-RAM 109 stores therein predetermined appropriate image density of each color.

After the photosensitive member 4Bk forms the Bk adjustment pattern on the transfer belt 1 and the pattern detecting sensor 2 detects the Bk adjustment pattern, the monochrome adjusting unit 201 refers to the image density stored in the NV-RAM 109 and adjusts the image density of Bk based on the image density of the Bk adjustment pattern detected by the pattern detecting sensor 2. The image density adjustment by the monochrome adjusting unit 201 is explained in detail below.

Figure 4:
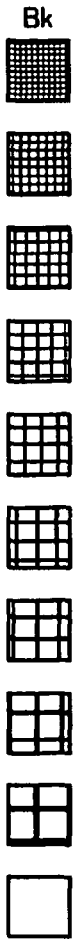
FIG. 4 is a schematic diagram of a Bk adjustment pattern according to the first embodiment.

FIG. 4 is a schematic diagram of the Bk adjustment pattern for adjusting the density of Bk. The Bk adjustment pattern includes 10 adjustment patches of Bk with different density levels. The adjustment patches are arranged in a line in gradations as shown in FIG. 4. The number of the adjustment patches is not limited to 10, and it can be less than 10, or more than 10. Upon receiving instructions from the controller 101, the photosensitive member 4Bk forms the Bk adjustment pattern on the transfer belt 1 such that the adjustment patches are arranged in a line in a sub-scanning direction of the transfer belt 1. When the pattern detecting sensor 2 detects the Bk adjustment pattern, the monochrome adjusting unit 201 measures the image density of Bk and compares the measured image density and the image density stored in the NV-RAM 109. Based on the result of the comparison, the monochrome adjusting unit 201 performs a feedback control to adjust the image density of Bk. The feedback control is performed using a known method so that explanation thereof is omitted below.

After the photosensitive members 4Y, 4M, 4C form the color adjustment pattern on the transfer belt 1 and the pattern detecting sensor 2 detects the color adjustment pattern, the color adjusting unit 202 refers to the image density stored in the NV-RAM 109 and adjusts the image density of Y, C, and M based on the image density of the color adjustment pattern detected by the pattern detecting sensor 2. The image density adjustment by the color adjusting unit 202 is explained in detail below.

Figure 5:
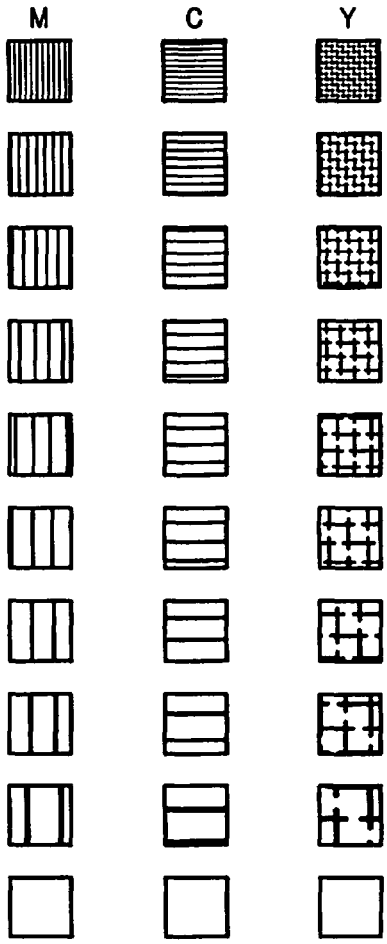
FIG. 5 is a schematic diagram of a color adjustment pattern according to the first embodiment.

FIG. 5 is a schematic diagram of the color adjustment pattern for adjusting the density of Y, M, and C at a time. The color adjustment pattern includes the Y, C, and M adjustment patterns each of which includes 10 adjustment patches of each color with different density levels. The adjustment patches are arranged in lines in gradations as shown in FIG. 5. The number of the adjustment patches is not limited to 10, and it can be less than 10, or more than 10. Upon receiving instructions from the controller 101, the photosensitive members 4Y, 4M, and 4C form the color adjustment pattern on the transfer belt 1 such that the adjustment patches are arranged in lines in the sub-scanning direction of the transfer belt 1. When the pattern detecting sensor 2 detects the color adjustment pattern, the color adjusting unit 202 measures the image density of each color and compares the measured image density and the image density stored in the NV-RAM 109. Based on the result of the comparison, the color adjusting unit 202 performs feedback control to adjust the image density of Y, C, and M. The feedback control is performed using the known method so that the explanation thereof is omitted below.

The adjustment determining unit 203 determines that an operation for adjusting the image density (hereinafter, "adjusting operation") is necessary when a predetermined time (hereinafter, "adjustment determination time") has passed, and determines whether to perform image density adjustment by the monochrome adjusting unit 201 or to perform image density adjustment by the color adjusting unit 202.

Figure 6:
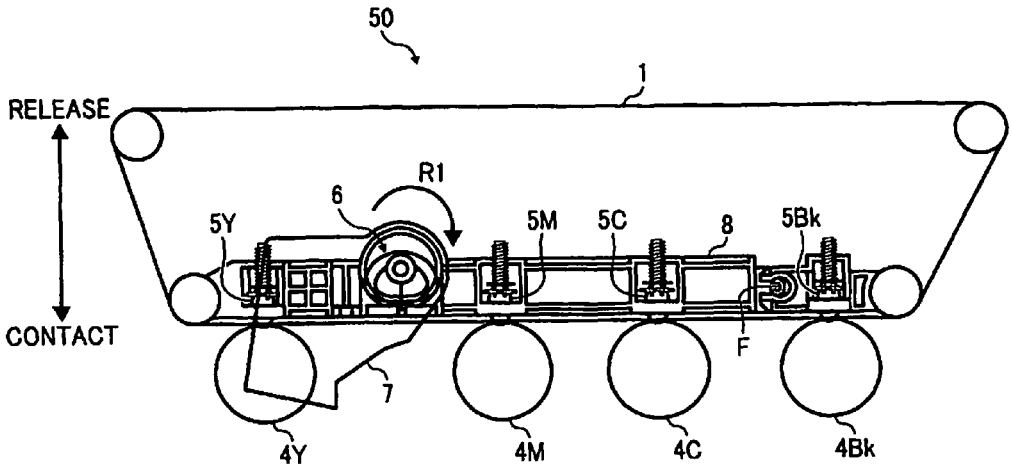
FIG. 6 is a schematic diagram of the image forming unit according to the first embodiment where photosensitive members are in contact with a transfer belt.
Figure 7:
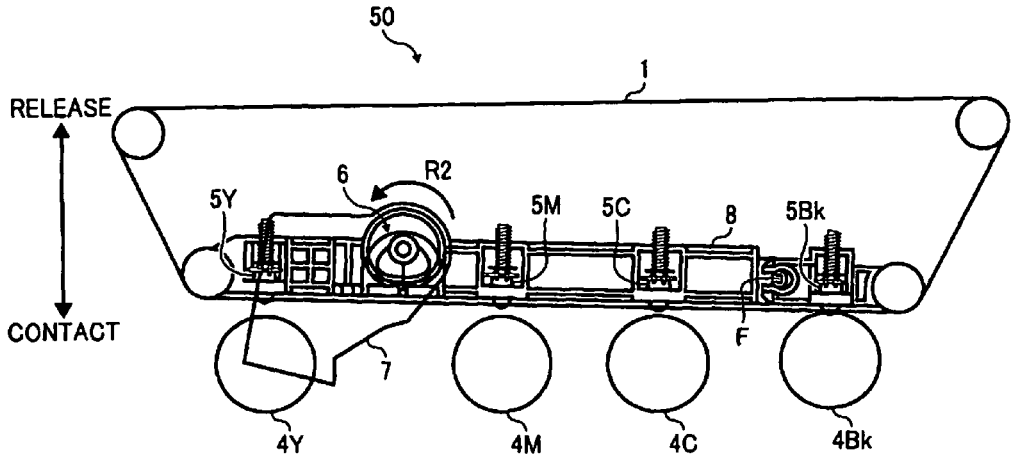
FIG. 7 is another schematic diagram of the image forming unit according to the first embodiment where the photosensitive members other than the one corresponding to Bk are released from the transfer belt.

The adjustment determining unit 203 determines whether to form a monochrome image or form a color image based on whether the photosensitive members 4Y, 4M, and 4C are in contact with the transfer belt 1 or are released from the transfer belt 1. A case where the photosensitive members 4Y, 4M, and 4C are released from the transfer belt 1 is explained below. FIGS. 6 and 7 are schematic diagrams of the image forming unit 50.

As shown in FIG. 1, the photosensitive members 4Y, 4M, 4C, and 4Bk are arranged along the transfer belt 1. As shown in FIG. 6, transfer rollers 5Y, 5M, 5C, and 5Bk are arranged so as to face the photosensitive members 4Y, 4M, 4C, and 4Bk with the transfer belt 1 positioned therebetween. The transfer rollers 5Y, 5M, 5C, and 5Bk are fixed to a fixation member 8 at predetermined intervals. The fixation member 8 is rotatable on a fulcrum F shown in FIG. 6 by a drive force from a direct current (DC) brush motor 7 and rotation of a cam 6.

The image forming unit 50 includes a contact detecting sensor (not shown) near the transfer rollers 5 or the cam 6. The contact detecting sensor detects whether the photosensitive members 4Y, 4M, and 4C are released from the transfer belt 1. When the contact detecting sensor detects that the photosensitive members 4Y, 4M, and 4C are released from the transfer belt 1, the contact detecting sensor sends a signal notifying that the photosensitive members 4Y, 4M, and 4C are released from the transfer belt 1 to the adjustment determining unit 203. On the other hand, when the contact detecting sensor detects that the photosensitive members 4Y, 4M, and 4C are in contact with the transfer belt 1, the contact detecting sensor sends a signal notifying that the photosensitive members 4Y, 4M, and 4C are in contact with the transfer belt 1 to the adjustment determining unit 203.

When the contact detecting sensor detects that the photosensitive members 4Y, 4M, and 4C are in contact with the transfer belt 1, the transfer rollers 5Y, 5M, 5C and 5Bk and the photosensitive members 4Y, 4M, 4C, and 4Bk are in contact with the transfer belt 1 as shown in FIG. 6. In this state, the photosensitive members 4Y, 4M, and 4C can transfer toner images onto the transfer belt 1, i.e., the printer 100 can print a color image on a recording medium. For this reason, when the adjustment determining unit 203 receives the signal notifying that the photosensitive members 4Y, 4M, and 4C are in contact with the transfer belt 1, the adjustment determining unit 203 determines to perform only image density adjustment by the color adjusting unit 202. Upon the adjustment determining unit 203 determining to perform only image density adjustment by the color adjusting unit 202, the photosensitive members 4Y, 4M, and 4C form the color adjustment pattern on the transfer belt 1 and the color adjusting unit 202 adjusts the image density of Y, C, and M. When the cam 6 rotates in a direction indicated by an arrow R1 shown in FIG. 6, the fixation member 8 rotates on the fulcrum F, so that the image forming unit 50 enters a state shown in FIG. 7 in which the photosensitive members 4Y, 4M, and 4C are released from the transfer belt 1.

When the contact detecting sensor detects that the photosensitive members 4Y, 4M, and 4C are released from the transfer belt 1, only the transfer roller 5Bk and the photosensitive member 4Bk are in contact with the transfer belt 1 interposed therebetween as shown in FIG. 7. In this state, the photosensitive members 4Y, 4M, and 4C cannot transfer toner images onto the transfer belt 1, i.e., the printer 100 can print only a monochrome image on a recording medium. For this reason, when the adjustment determining unit 203 receives the signal notifying that the photosensitive members 4Y, 4M, and 4C are released from the transfer belt 1, the adjustment determining unit 203 determines to perform only image density adjustment by the monochrome adjusting unit 201. Upon the adjustment determining unit 203 determining to perform only image density adjustment by the monochrome adjusting unit 201, the photosensitive member 4Bk forms the Bk adjustment pattern on the transfer belt 1 and the monochrome adjusting unit 201 adjusts the image density of Bk. When the cam 6 rotates in a direction indicated by an arrow R2 shown in FIG. 7, the fixation member 8 rotates on the fulcrum F, so that the image forming unit 50 enters a state shown in FIG. 6 in which the photosensitive members 4Y, 4M, 4C, and 4Bk are in contact with the transfer belt 1.

As explained above, the adjustment determining unit 203 determines to perform only image density adjustment by the monochrome adjusting unit 201 when the photosensitive members 4Y, 4M, and 4C are released from the transfer belt 1. On the other hand, the adjustment determining unit 203 determines to perform only image density adjustment by the color adjusting unit 202 when the photosensitive members 4Y, 4M, and 4C are in contact with the transfer belt 1.

The adjustment determining unit 203 determines whether the adjusting operation is necessary based on whether the adjustment determination time has passed. Alternatively, the adjustment determining unit 203 can be configured to determine whether the adjusting operation is necessary based on a predetermined number of printed images or a predetermined temperature.

Adjustment of the image density of Y, M, C, and Bk at a time in the conventional technology is explained below.

Figure 8:
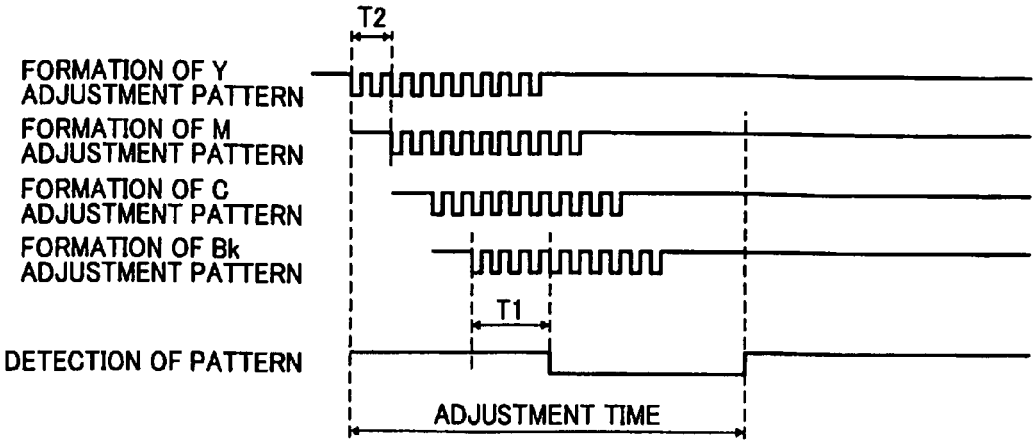
FIG. 8 is a timing chart of an image-density adjustment process performed in a conventional technology.

FIG. 8 is a timing chart of an image-density adjustment process performed in the conventional technology. In the timing chart, each of the photosensitive members 4Y, 4M, 4C, and 4Bk is considered to form each adjustment pattern of each color at a logical LOW timing. Similarly, the pattern detecting sensor 2 is considered to detect the adjustment pattern at the logical LOW timing.

In a conventional printer, when printing a color image, image density of Y, M, C, and Bk is adjusted. As shown in FIG. 8, first, the photosensitive member 4Y forms a Y adjustment pattern on the transfer belt 1. After a time T2, in which the transfer belt 1 moves the distance L2 from the position at which the photosensitive member 4Y forms the Y adjustment pattern to a position at which the photosensitive member 4M forms an M adjustment pattern, the photosensitive member 4M forms the M adjustment pattern on the transfer belt 1. Similarly, the photosensitive members 4C and 4Bk form C and Bk adjustment patterns sequentially.

Figure 9:
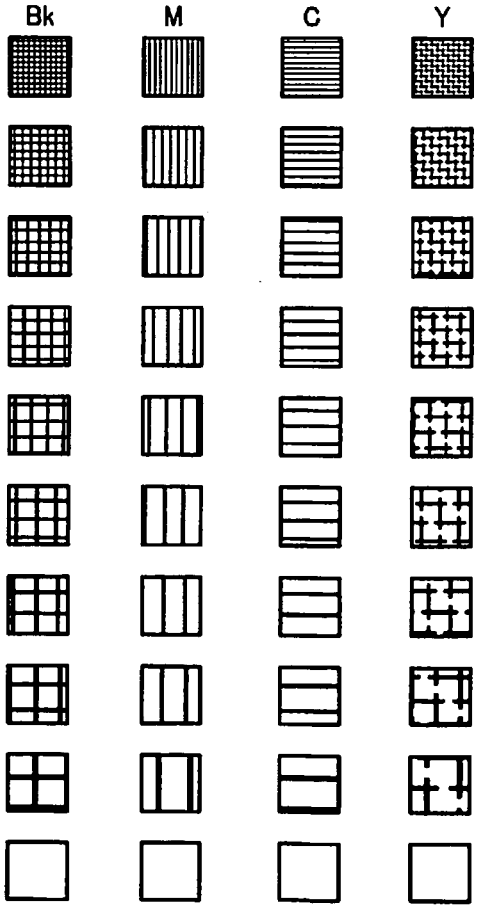
FIG. 9 is a schematic diagram of a conventional adjustment pattern.

The adjustment pattern formed by the conventional printer is explained below. FIG. 9 is a schematic diagram of the conventional adjustment pattern. The conventional adjustment pattern includes the Y, M, C, and Bk adjustment patterns each of which includes 10 adjustment patches of each color with different density levels. The adjustment patches are arranged in gradations in parallel lines as shown in FIG. 9. The photosensitive members 4Y, 4M, 4C, and 4Bk form the adjustment pattern on the transfer belt 1 such that the adjustment patches are arranged in parallel lines in the sub-scanning direction of the transfer belt 1. When the pattern detecting sensor 2 detects the adjustment pattern, the image density of each color is adjusted.

When sequentially forming the Y, M, C, and Bk adjustment patterns on the transfer belt 1, after a predetermined time T1 has passed from the start of forming the last adjustment pattern (i.e., Bk adjustment pattern), the pattern detecting sensor 2 starts detecting the adjustment pattern. In the predetermined time T1, the transfer belt 1 moves the distance L1 from the position at which the Bk adjustment pattern is formed to the position at which the pattern detecting sensor 2 detects the adjustment pattern. Precisely, it is necessary to consider charging start timing, exposing start timing, and the like, although explanations thereof are omitted in the description.

The time from the start of the image density adjustment until the completion of image density adjustment is a time from the start of forming the adjustment pattern until the completion of image density adjustment by the monochrome adjusting unit 201 or the color adjusting unit 202, in which the pattern detecting sensor 2 detects the adjustment pattern. This definition applies to the first embodiment.

Figure 10:
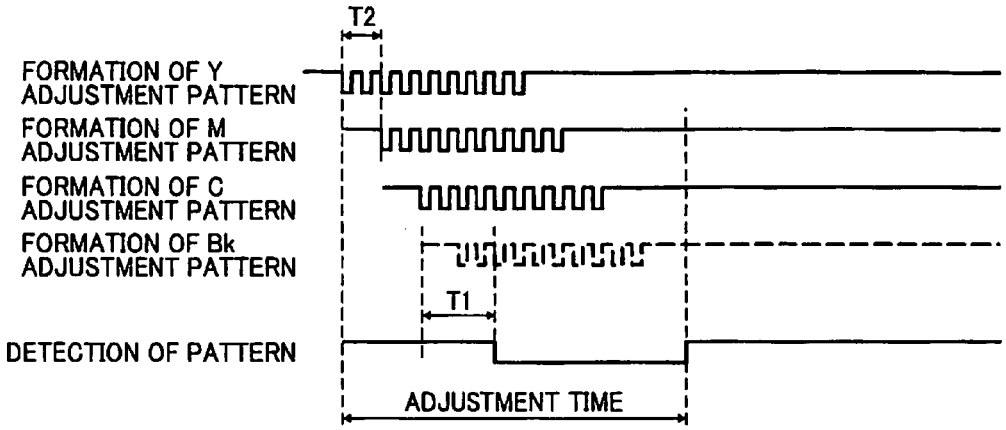
FIG. 10 is a timing chart of adjusting image density of Y, C, and M according to the first embodiment.

Adjustment of density of Y, C, and M of a color image by the printer 100 is explained below. FIG. 10 is a timing chart of adjusting image density of Y, C, and M.

In the printer 100, when printing a color image, image density of Y, M, and C excluding Bk is adjusted. As shown in FIG. 10, first, the photosensitive member 4Y forms the Y adjustment pattern on the transfer belt 1. After the time T2, in which the transfer belt 1 moves the distance L2 from the position at which the photosensitive member 4Y forms the Y adjustment pattern to a position at which the photosensitive member 4M forms the M adjustment pattern, the photosensitive member 4M forms the M adjustment pattern on the transfer belt 1. Similarly, the photosensitive member 4C forms the C adjustment pattern. However, the Bk adjustment pattern is not formed; therefore, the timing chart for formation Bk adjustment patter is shown as a dotted line.

When sequentially forming the Y, M, and C adjustment patterns on the transfer belt 1, after a predetermined time T2 has passed from the start of forming the last adjustment pattern (i.e., the C pattern), the pattern detecting sensor 2 starts detecting the color adjustment pattern. The predetermined time T2 is similarly defined as the conventional technology.

From the comparison of the timing charts of FIGS. 10 and 8, it can be found that the timing shown in FIG. 10 at which the pattern detecting sensor 2 starts detecting the color adjustment pattern is earlier than that by the conventional technology because the Bk adjustment pattern is not formed. In other words, the time for adjusting the image density of Y, C, and M in the embodiment is shorter than that in the conventional technology.

Figure 11:
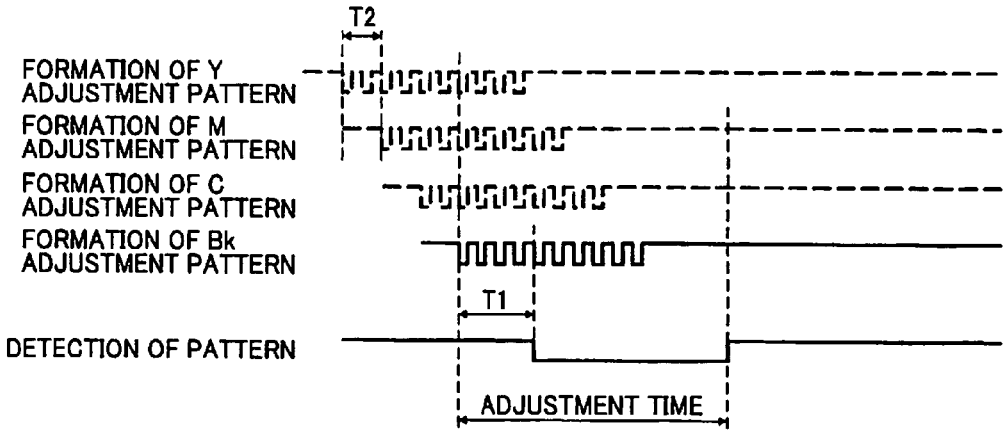
FIG. 11 is a timing chart of adjusting image density of Bk according to the first embodiment.

Adjustment of density of a monochrome image according to the first embodiment is explained below. FIG. 11 is a timing chart of adjusting density of a monochrome image.

As explained above, in the printer 100, when forming a monochrome image, only the image density of Bk is adjusted. As shown in FIG. 11, the photosensitive member 4Bk forms the Bk adjustment pattern on the transfer belt 1. The Y, M, and C adjustment patterns are not formed as explained above.

After the Bk adjustment pattern is formed on the transfer belt 1 and a predetermined time has passed, the pattern detecting sensor 2 starts detecting the Bk adjustment pattern. The predetermined time is similarly defined as the conventional technology.

Compared with the timing chart of FIG. 8, the timing shown in FIG. 11 at which the pattern detecting sensor 2 starts detecting the Bk adjustment pattern is earlier than that in the conventional technology because the Y, M, and C adjustment patterns are not formed. In other words, the time for adjusting the image density of a monochrome image in the embodiment is shorter than that in the conventional technology. In addition, compared to the timing chart of FIG. 10, the time for adjusting density of a monochrome image is shorter than the time for adjusting the image density of Y, C, and M.

Figure 12:
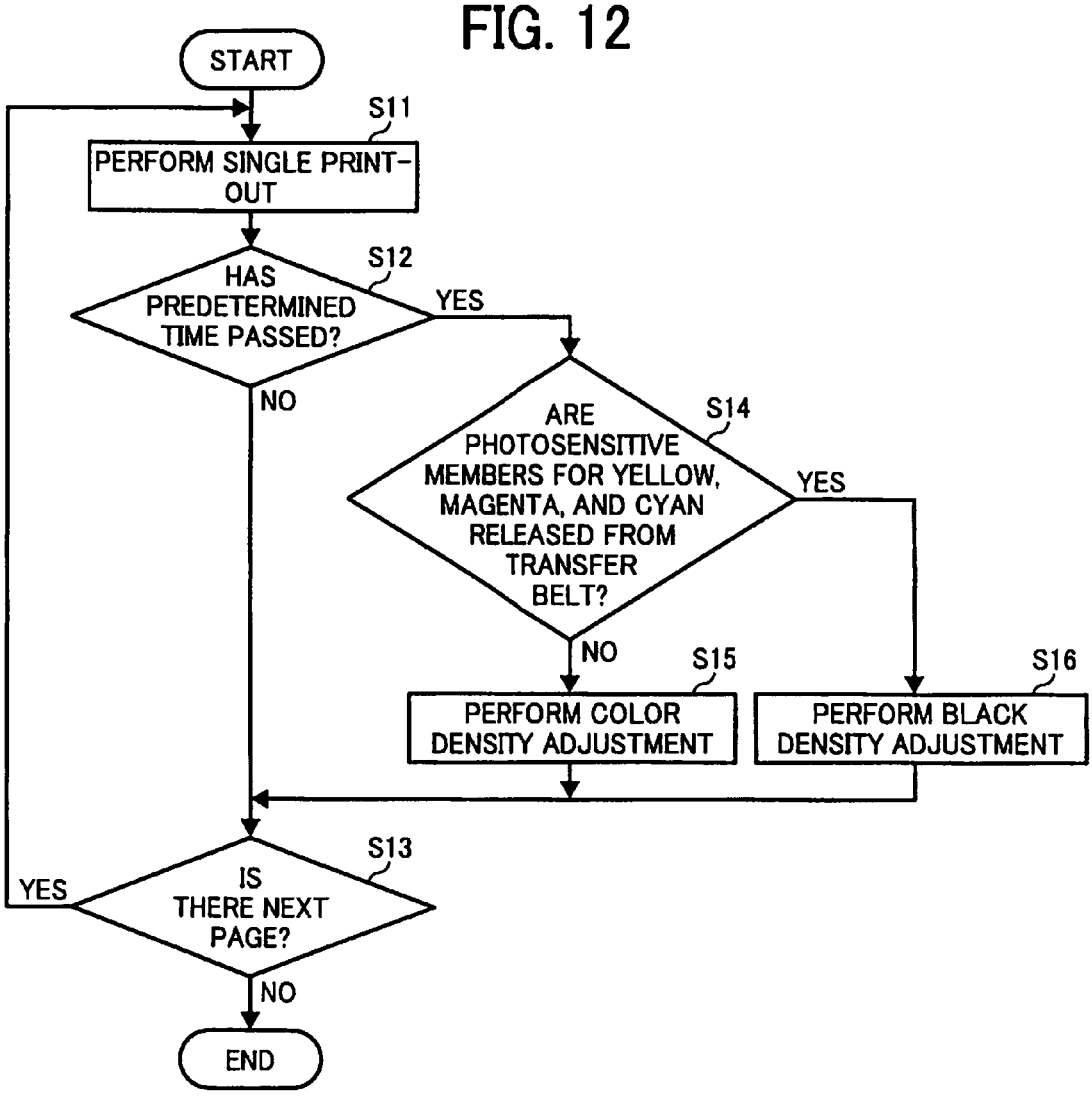
FIG. 12 is a flowchart of a printing process performed by the image forming apparatus according to the first embodiment.

The printing process performed by the printer 100 is explained. FIG. 12 is a flowchart of the printing process performed by the printer 100.

The printer engine 130 prints a color image or a monochrome image (Step S11). The adjustment determining unit 203 determines whether the adjustment determination time has passed (Step S12). When the adjustment determination time has not passed (NO at Step S12), the adjustment determining unit 203 determines that the adjusting operation is unnecessary and the printer engine 130 determines whether there is the next image to be printed (Step S13). When there is no next image to be printed (NO at Step S13), the printing process is completed. On the other hand, when there is the next image to be printed (YES at Step S13), the process control goes back to Step S11 and the processing is repeated.

When adjustment determination time has passed (YES at Step S12), the adjustment determining unit 203 determines that the adjusting operation is necessary and determines whether the photosensitive members 4Y, 4M, and 4C are released from the transfer belt 1 (Step S14). When the photosensitive members 4Y, 4M, and 4C are released from the transfer belt 1 (YES at Step S14), the adjustment determining unit 203 determines to perform only image density adjustment by the monochrome adjusting unit 201, and the monochrome adjusting unit 201 adjusts the image density of Bk (Step S16).

When the photosensitive members 4Y, 4M, and 4C are not released from, i.e., are in contact with, the transfer belt 1 (NO at Step S14), the adjustment determining unit 203 determines to perform only image density adjustment by the color adjusting unit 202; and therefore, the color adjusting unit 202 adjusts the image density of Y, M, and C (Step S15).

As explained above, in the printer 100, when the photosensitive members 4Y, 4M, and 4C are released from the transfer belt 1, it is determined that a monochrome image can be printed; and therefore only the image density of Bk is adjusted. On the other hand, when the photosensitive members 4Y, 4M, and 4C are in contact with the transfer belt 1, it is determined that a color image can be printed, and therefore only the image density of Y, M, and C is adjusted. For this reason, compared with the case where the image density of all four colors, including Bk, are adjusted, each of the time for adjusting the image density of Bk and the time for adjusting the image density of Y, C, and M can be shortened. This shortens the waiting time to the user, which increases convenience of the printer 100. Furthermore, when forming a monochrome image, the photosensitive members 4Y, 4M, and 4C are released from the transfer belt 1, which extends the life of the photosensitive members 4Y, 4M, and 4C.

The printer 100 determines whether to perform image density adjustment by the monochrome adjusting unit 201 or to perform image density adjustment by the color adjusting unit 202. On the other hand, in a printer according to a second embodiment of the present invention, whether to perform image density adjustment by the monochrome adjusting unit 201 or to perform image density adjustment by the color adjusting unit 202 is determined based on which of a monochrome mode and a color mode is set as the printing mode.

Figure 13:
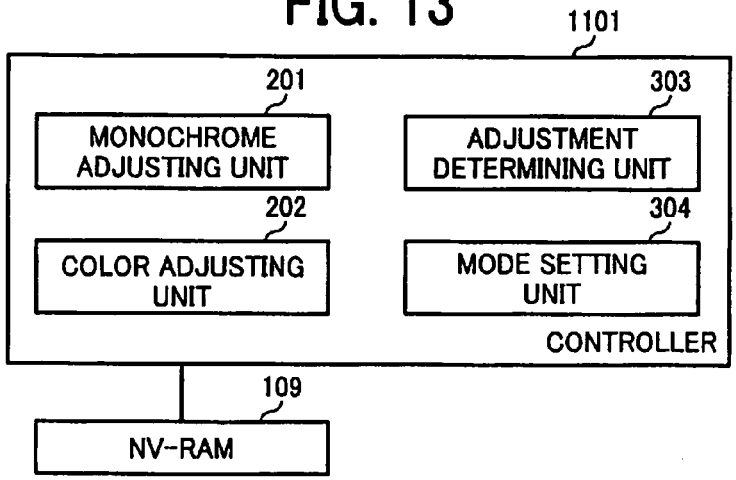
FIG. 13 is a functional block diagram of a controller of an image forming apparatus according to a second embodiment of the present invention.

The printer and an image forming unit according to the second embodiment basically have the same configurations as those of the first embodiment, and the same explanation is not repeated (see FIGS. 1 and 2). The printer according to the second embodiment includes a controller 1101 instead of the controller 101. FIG. 13 is a functional block diagram of the controller 1101. Control by the controller 1101 is explained below.

The controller 1101 includes the monochrome adjusting unit 201, the color adjusting unit 202, an adjustment determining unit 303, and a mode setting unit 304. The NV-RAM 109 is connected to the controller 1101.

The mode setting unit 304 sets the printing mode of the printer. Specifically, when the mode setting unit 304 receives an instruction for a monochrome mode in which an image is formed on a recording medium using only Bk or a color mode in which an image is formed on a recording medium using Y, M, C, and Bk, which is made by a user via the operation panel 120, the mode setting unit 304 stores the monochrome mode or the color mode in the NV-RAM 109, thereby setting the printing mode.

When the printing mode is switched from/to the monochrome mode or the color mode, the adjustment determining unit 303 determines that the adjusting operation is necessary and determines whether to perform image density adjustment by the monochrome adjusting unit 201 or to perform image density adjustment by the color adjusting unit 202 based on the type of an image to be formed on a recording medium.

Specifically, when the mode setting unit 304 sets the monochrome mode, i.e., the printing mode is switched from the color mode to the monochrome mode, a monochrome image can be formed; and therefore, the adjustment determining unit 303 determines to perform only image density adjustment by the monochrome adjusting unit 201. On the other hand, when the mode setting unit 304 sets the color mode, i.e., switches the printing mode from the monochrome mode to the color mode, a color image can be formed; and therefore, the adjustment determining unit 303 determines to perform only image density adjustment by the color adjusting unit 202.

The time for image density adjustment by the conventional technology and the time for image density adjustment by the printer in the second embodiment are same as those of the first embodiment (see FIGS. 8, 10, and 11), and the same explanation is not repeated below.

Figure 14:
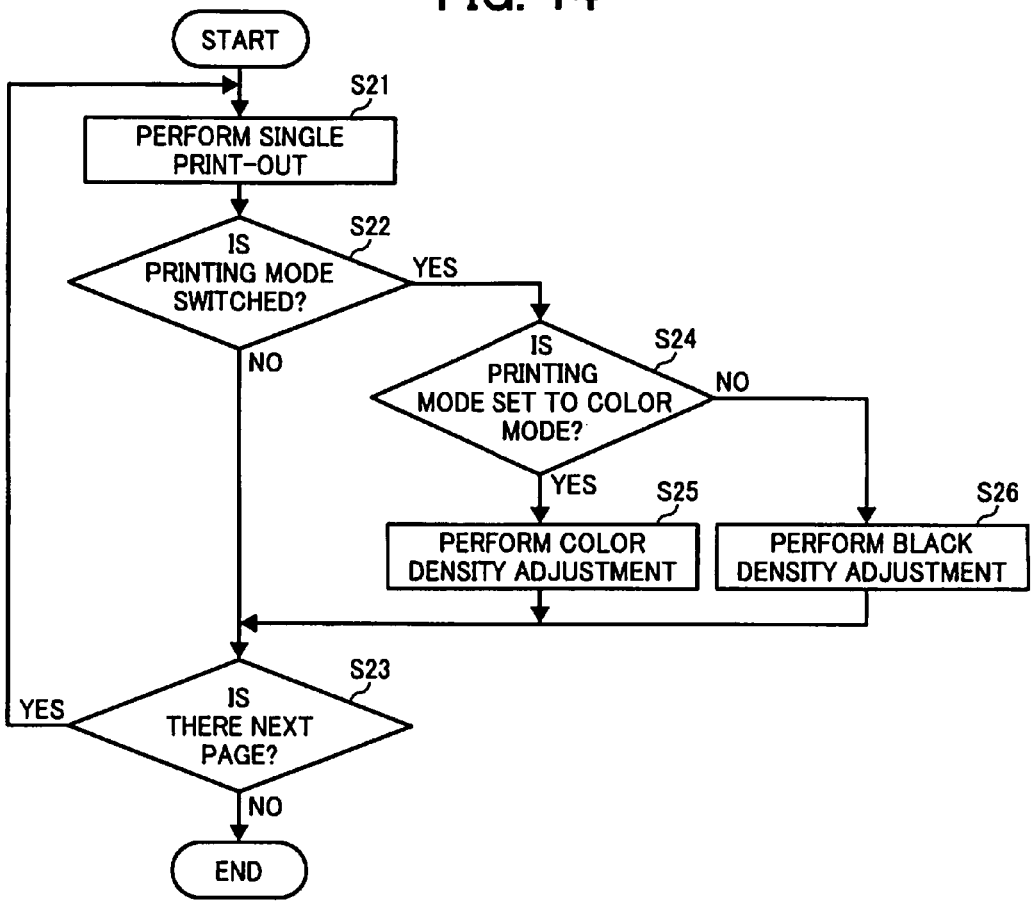
FIG. 14 is a flowchart of a printing process performed by the image forming apparatus according to the second embodiment.

A printing process performed by the printer according to the second embodiment is explained below. FIG. 14 is a flowchart of the printing process performed by the printer according to the second embodiment.

The printer engine 130 prints a color image or a monochrome image (Step S21). The adjustment determining unit 303 determines whether the printing mode is switched (Step S22). When the printing mode is not switched (NO at Step S22), the adjustment determining unit 303 determines whether there is the next image to be printed (Step S23). When there is no next image to be printed (NO at Step S23), the printing process is completed. On the other hand, when there is the next image to be printed (YES at Step S23), the process control goes back to Step S21 and the same processing is repeated.

When the printing mode is switched (YES at Step S22), the adjustment determining unit 303 determines whether the printing mode is set to the color mode (Step S24). When the printing mode is not set to the color mode, i.e., the printing mode is set to the monochrome mode (NO at Step S24), the adjustment determining unit 303 determines to perform only image density adjustment by the monochrome adjusting unit 201 and the monochrome adjusting unit 201 adjusts the image density of Bk (Step S25).

On the other hand, when the printing mode is set to the color mode (YES at Step S24), the adjustment determining unit 303 determines to perform only image density adjustment by the color adjusting unit 202 and the color adjusting unit 202 adjusts the image density of Y, M, and C (Step S25).

As explained above, in the printer according to the second embodiment, when the printing mode is set to the monochrome mode, it is determined that a monochrome image can be printed; and therefore, only the image density of Bk is adjusted. On the other hand, when the printing mode is set to the color mode, it is determined that a color image can be printed; and therefore, only the image density of Y, M, and C is adjusted. For this reason, compared with the case where the image density of all four colors including Bk is adjusted, each of the time for adjusting the image density of Bk and the time for adjusting the image density of Y, C, and M can be shortened. This shortens the waiting time to the user, which increases convenience of the printer.

The color adjustment pattern according to the first embodiment formed on the transfer belt 1 includes the adjustment patterns of Y, M, and C arranged in parallel to each other in the sub-scanning direction of the transfer belt 1. On the other hand, in a printer according a third embodiment of the present invention, a color adjustment pattern formed on the transfer belt 1 includes adjustment patterns of C, M, Y formed linearly in the sub-scanning direction of the transfer belt 1.

The printer, an image forming unit, and a controller according to the third embodiment basically have the same structures and functional configurations as those of the first embodiment (see FIGS. 1 to 3), and the same explanation is not repeated below.

Figure 15:
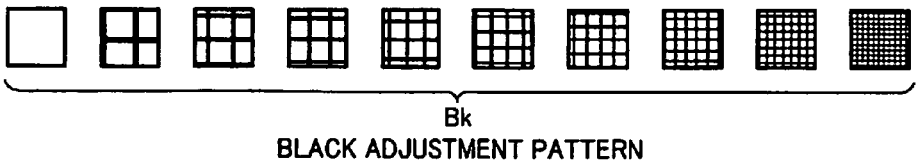
FIG. 15 is a schematic diagram of a Bk adjustment pattern according to a third embodiment of the present invention.

The adjustment pattern formed on the transfer belt 1 in the third embodiment is explained below. FIG. 15 is a schematic diagram of the Bk adjustment pattern according to the third embodiment. The Bk adjustment pattern includes 10 adjustment patches of Bk with different density levels. The adjustment patches are arranged linearly in gradations as shown in FIG. 15. The number of the adjustment patches is not limited to 10, and it can be less than 10, or more than 10. Upon receiving instructions from the controller 101, the photosensitive member 4Bk forms the Bk adjustment pattern on the transfer belt 1 such that the adjustment patches are arranged linearly in the sub-scanning direction of the transfer belt 1. When the pattern detecting sensor 2 detects the Bk adjustment pattern, the monochrome adjusting unit 201 measures the image density of Bk and compares the measured image density and the image density stored in the NV-RAM 109. Based on the result of the comparison, the monochrome adjusting unit 201 performs a feedback control to adjust the image density of Bk. The explanation for the feedback control is omitted as the first embodiment.

Figure 16:
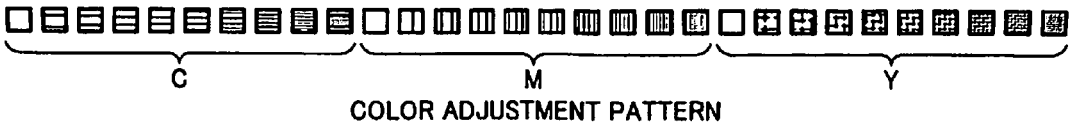
FIG. 16 is a schematic diagram of a color adjustment pattern according to the third embodiment.

FIG. 16 is a schematic diagram of the color adjustment pattern for adjusting the density of C, M, and Y at a time according to the third embodiment. The color adjustment pattern includes a C, M, and Y adjustment patterns each of which includes 10 adjustment patches of each color with different density levels. The adjustment patches are arranged linearly in gradations as shown in FIG. 16. The number of the adjustment patches is not limited to 10, and it can be less than 10, or more than 10. Upon receiving instructions from the controller 101, the photosensitive members 4C, 4M, and 4Y sequentially form the C, M, and Y adjustment patterns on the transfer belt 1 linearly. When the pattern detecting sensor 2 detects the color adjustment pattern, the color adjusting unit 202 measures the image density of each color and compares the measured image density and the image density stored in the NV-RAM 109. Based on the result of the comparison, the color adjusting unit 202 performs a feedback control to adjust the image density of C, M, and Y.

Adjustment of the image density of Bk, C, M, and Y at a time in the conventional technology is explained below.

Figure 17:
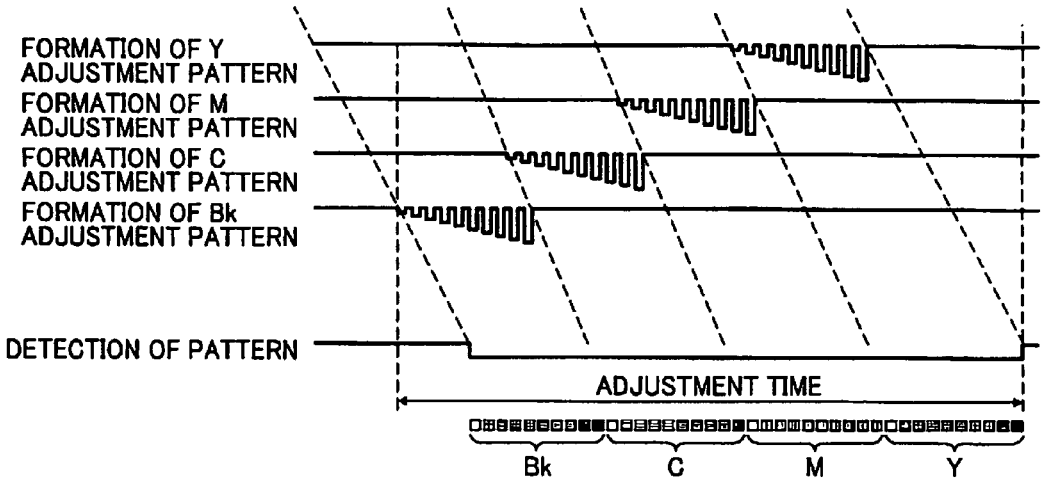
FIG. 17 is a timing chart of an image-density adjustment process performed in the conventional technology.

FIG. 17 is a timing chart of the image-density adjustment process performed in the conventional technology. In the timing chart, each of the photosensitive members 4Bk, 4C, 4M, and 4Y is considered to form each adjustment pattern of each color at a logical LOW timing. Similarly, the pattern detecting sensor 2 is considered to detect the adjustment pattern at the logical LOW timing.

In the conventional printer, when printing a color image, image density of Bk, C, M, and Y is adjusted. As shown in FIG. 17, first, the photosensitive member 4Bk forms a Bk adjustment pattern on the transfer belt 1. At a predetermined timing after the photosensitive member 4Bk starts forming the Bk adjustment pattern, the photosensitive member 4C forms a C adjustment pattern on the transfer belt 1. The predetermined timing is timing when a distance of the rest of the adjustment pattern to be formed by the photosensitive member 4Bk is equal to a distance between a position at which the photosensitive member 4Bk forms the Bk adjustment pattern and a position at which the photosensitive member 4C forms the C adjustment pattern. Similarly, the photosensitive members 4M and 4Y form M and Y adjustment patterns sequentially.

Figure 18:
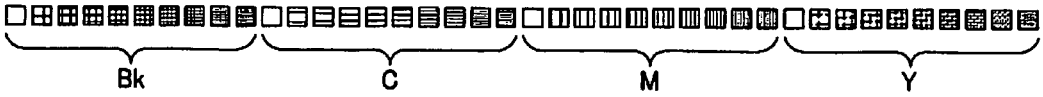
FIG. 18 is a schematic diagram of another conventional adjustment pattern.

The adjustment pattern formed by the conventional printer is explained below. FIG. 18 is a schematic diagram of the conventional adjustment pattern. The conventional adjustment pattern includes the Bk, C, M, and Y adjustment patterns each of which includes 10 adjustment patches of each color with different density levels. The adjustment patches are arranged in line in gradations as shown in FIG. 18. The photosensitive members 4Bk, 4C, 4M, and 4Y form the adjustment pattern on the transfer belt 1 such that the adjustment patches are arranged linearly in the sub-scanning direction of the transfer belt 1. The pattern detecting sensor 2 detects the adjustment pattern. Based on the result of the detection, the image density of each color is adjusted.

When sequentially forming the Bk, C, M, and Y adjustment patterns after a predetermined time has passed from the start of forming the first adjustment pattern (i.e., Bk adjustment pattern) on the transfer belt 1, the pattern detecting sensor 2 starts detecting the adjustment pattern. The predetermined time is the time T1, in which the transfer belt 1 moves the distance L1 from the position at which the Bk adjustment pattern is formed to the position at which the pattern detecting sensor 2 detects the adjustment pattern. Precisely, it is necessary to consider a charging start timing, an exposing start timing, and the like, although explanations thereof are omitted in the description.

Figure 19:
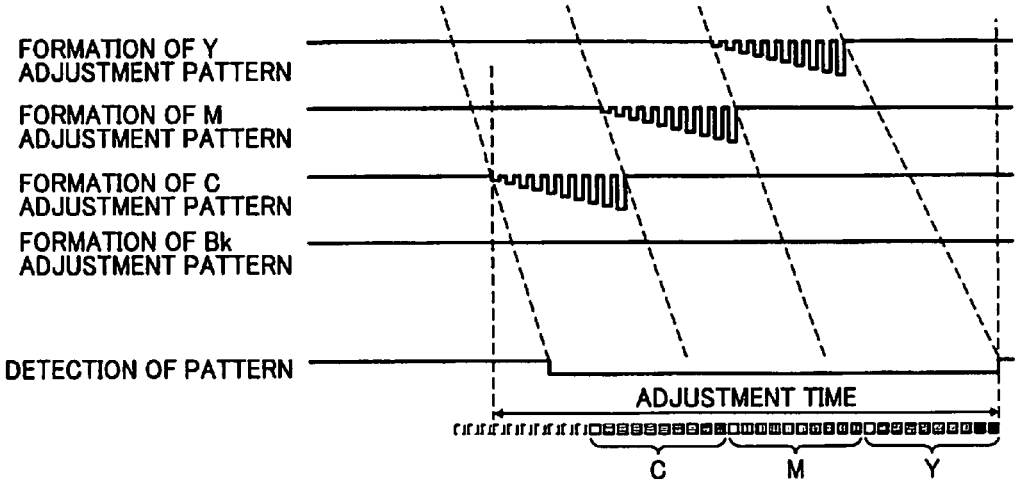
FIG. 19 is a timing chart of adjusting image density of Y, C, and M according to the third embodiment.

Adjustment of image density of Y, C, and M by the printer according to the third embodiment is explained below. FIG. 19 is a timing chart of adjusting image density of Y, C, and M according to the third embodiment.

In the printer according to the third embodiment, when printing a color image, image density of C, M, and Y is adjusted. As shown in FIG. 19, first, the photosensitive member 4C forms the C adjustment pattern on the transfer belt 1. At predetermined timing after the photosensitive member 4C starts forming the C adjustment pattern, the photosensitive member 4M forms the M adjustment pattern on the transfer belt 1. The predetermined timing is same as the conventional technology (see FIG. 17). Similarly, the photosensitive member 4Y forms the Y adjustment pattern. However, the Bk adjustment pattern is not formed.

In the printer according to the third embodiment, the C, M, Y patterns are formed sequentially, and this adjustment pattern forming order is opposite to that according to the first embodiment. Specifically, when sequentially forming the Y, M, and C adjustment patterns as the first embodiment, forming the M adjustment pattern is started after forming the Y adjustment pattern, and forming the C adjustment pattern is started after forming the M adjustment pattern. On the other hand, when sequentially forming the C, M, Y patterns as the third embodiment, forming the M adjustment pattern is started before forming the C adjustment pattern is completed. Furthermore, before forming the M adjustment is completed, forming the Y adjustment pattern can be started. In the third embodiment, at a certain time the C and the M adjustment patterns are formed simultaneously and at a certain time the M and Y adjustment patterns are formed simultaneously, which shortens the time for image concentration adjustment compared with the case in which the Y, M, C adjustment patterns are formed sequentially.

When sequentially forming the C, M, and Y adjustment patterns (i.e., the color adjustment pattern is formed) on the transfer belt 1, after a predetermined time has passed from the start of forming the first adjustment pattern (i.e., the C pattern), the pattern detecting sensor 2 starts detecting the color adjustment pattern. The predetermined time is similarly defined as the conventional technology.

From comparison between the timing charts of FIGS. 19 and 17, it can be found that the time at which the pattern detecting sensor 2 completes detecting the color adjustment pattern according to the third embodiment is earlier than that in the conventional technology because the Bk adjustment pattern is not formed. In other words, the time for adjusting the image density of Y, C, and M in the embodiment is shorter than that in the conventional technology.

Figure 20:
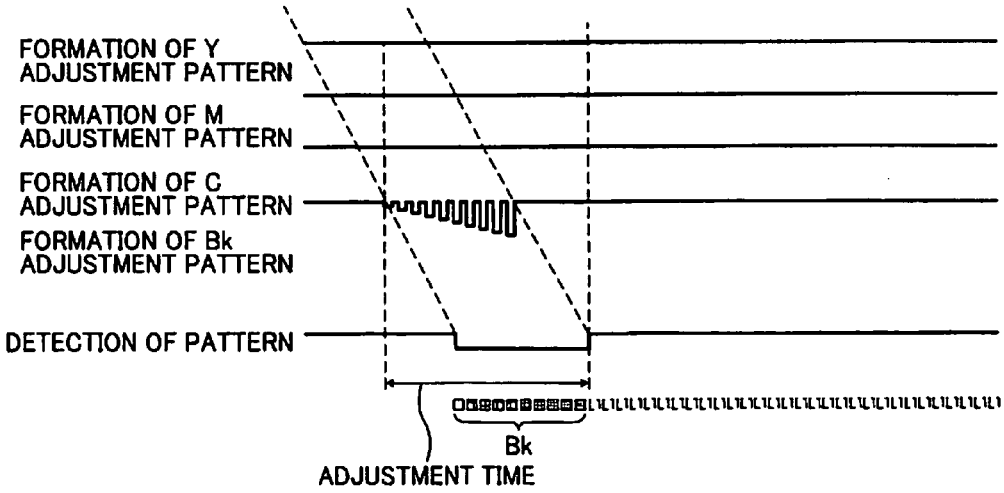
FIG. 20 is a timing chart of adjusting density of a monochrome image according to the third embodiment.

Adjustment of density of a monochrome image according to the third embodiment is explained below. FIG. 20 is a timing chart of adjusting density of a monochrome image.

As explained above, in the printer according to the third embodiment, when forming a monochrome image, only the image density of Bk is adjusted. As shown in FIG. 20, the photosensitive member 4Bk forms the Bk adjustment pattern on the transfer belt 1. The Y, M, and C adjustment patterns are not formed as explained above.

After the Bk adjustment pattern is formed on the transfer belt 1 and the predetermined time T2 has passed, the pattern detecting sensor 2 starts detecting the Bk adjustment pattern. The predetermined time T2 is similarly defined as the conventional technology.

From comparison between the timing charts of FIGS. 20 and 17, it can be found that the time shown in FIG. 20 at which the pattern detecting sensor 2 completes detecting the Bk adjustment pattern is earlier than that in the conventional technology because the Y, M, and C adjustment patterns are not formed in the third embodiment. In other words, the time for adjusting the image density of a monochrome image in the embodiment is shorter than that in the conventional technology. In addition, from comparison between the timing charts of FIGS. 20 and 19, the time for adjusting density of a monochrome image is shorter than the time for adjusting the image density of Y, C, and M because only the Bk adjustment pattern is formed.

The flow of a printing process performed by the printer according to the third embodiment is basically same as that of the first embodiment, and the same explanation thereof is not repeated below (see FIG. 12).

In the printer according to the third embodiment, when the photosensitive members 4Y, 4M, and 4C are released from the transfer belt 1, it is determined that a monochrome image can be printed; and therefore, only the image density of Bk is adjusted. On the other hand, when the photosensitive members 4Y, 4M, and 4C are in contact with the transfer belt 1, it is determined that a color image can be printed; and therefore, only the image density of Y, M, and C is adjusted. For this reason, compared with the case where the image density of all four colors including Bk is adjusted, each of the time for adjusting the image density of Bk and the time for adjusting the image density of Y, C, and M can be shortened. This shortens the waiting time to the user, which increases convenience of the printer. Furthermore, when the C, M, and Y adjustment patterns are formed linearly, the adjustment pattern of each color can be detected by only one sensor. Therefore, it is unnecessary to use a plurality of sensors and make adjustment for variations in characteristics between the sensors, reducing the manufacturing cost.

In the printer according to the third embodiment, as the first embodiment, whether to perform image density adjustment by the monochrome adjusting unit 201 or to perform image density adjustment by the color adjusting unit 202 is determined based on whether the photosensitive members 4Y, 4M, and 4C are released from the transfer belt 1. Alternatively, as the second embodiment, whether to perform image density adjustment by the monochrome adjusting unit 201 or to perform image density adjustment by the color adjusting unit 202 can be determined based on which of the monochrome mode and the color mode is set as the printing mode.

Although the printers according to the first to the third embodiments use Bk, M, C, and Y, the number and type of colors can be changed.

According to one aspect of the present invention, the time for adjusting the image density of Bk and the time for adjusting the image density of colors other than Bk can be reduced, which reduces waiting time to a user and increases convenience.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus for forming an image by superimposing a plurality of single-color images on a recording medium, the image forming apparatus comprising:

an image carrier configured to carry an image;

an image forming unit that is configured to form an image on the image carrier with predetermined density and transfers the image onto the recording medium, wherein the image forming unit forms a first pattern of black with a plurality-of density levels and a second pattern of a plurality of colors other than black with a plurality of density levels on the image carrier;

a pattern detecting unit that detects the first pattern and the second pattern formed on the image carrier;

a first adjusting unit that performs a first adjustment of adjusting density of black based on the first pattern detected by the pattern detecting unit when the image forming unit is to form an image that is to be transferred on the recording medium;

a second adjusting unit that performs a second adjustment of adjusting density of colors other than black based on the second pattern detected by the pattern detecting unit when the image forming unit is to form an image that is to be transferred onto the recording medium; and a determining unit that determines whether to perform the first adjustment or to perform the second adjustment based on a type of the image to be formed on the recording medium, wherein the second pattern includes a plurality of patterns of respective colors other than black, and the image forming unit forms the patterns of the colors other than black on the image carrier in parallel to each other in a sub-scanning direction of the image carrier.

2. The image forming apparatus according to claim 1, wherein when the image is a black image, the determining unit determines to perform the first adjustment.

3. The image forming apparatus according to claim 2, wherein when the image is a color image, the determining unit determines to perform the second adjustment.

4. The image forming apparatus according to claim 1, wherein the image forming unit includes a first image forming unit that forms the first pattern on the image carrier; and a second image forming unit that forms the second pattern on the image carrier, the image forming apparatus further comprises a contact determining unit that determines whether the second image forming unit is in contact with the image carrier, and the determining unit determines to perform the first adjustment when the contact determining unit determines that the second image forming unit is not in contact with the image carrier, and to perform the second adjustment when the contact determining unit determines that the second image forming unit is in contact with the image carrier.

5. The image forming apparatus according to claim 1, further comprising a mode switching unit that switches a print mode between a monochrome mode in which a black image is formed on the recording medium and a color mode in which a color image is formed on the recording medium, wherein the determining unit determines to perform the first adjustment when a current print mode is the monochrome mode, and to perform the second adjustment when the current print mode is the color mode.

6. An image forming apparatus for forming an image by superimposing a plurality of single-color images on a recording medium, the image forming apparatus comprising:

an image carrier configured to carry an image;

an image forming unit that is configured to form an image on the image carrier with predetermined density and transfers the image onto the recording medium, wherein the image forming unit forms a first pattern of black with a plurality-of density levels and a second pattern of a plurality of colors other than black with a plurality of density levels on the image carrier;

a pattern detecting unit that detects the first pattern and the second pattern formed on the image carrier;

a first adjusting unit that performs a first adjustment of adjusting density of black based on the first pattern detected by the pattern detecting unit when the image forming unit is to form an image that is to be transferred on the recording medium;

a second adjusting unit that performs a second adjustment of adjusting density of colors other than black based on the second pattern detected by the pattern detecting unit when the image forming unit is to form an image that is to be transferred onto the recording medium; and a determining unit that determines whether to perform the first adjustment or to perform the second adjustment based on a type of the image to be formed on the recording medium, wherein the second pattern includes a plurality of patterns of respective colors other than black, and the image forming unit forms the patterns of the colors other than black on the image carrier in parallel to each other in a direction orthogonal to a sub-scanning direction of the image carrier.

7. The image forming apparatus according to claim 1, wherein a time for performing the first adjustment is shorter than a time for performing the second adjustment.

8. A method of adjusting density of an image that is formed by superimposing a plurality of single-color images on a recording medium, the method comprising:

forming a first pattern of black with a plurality of density levels and a second pattern of a plurality of colors other than black with a plurality of density levels on an image carrier;

detecting the first pattern and the second pattern formed on the image carrier;

first adjusting including performing a first adjustment of adjusting density of black based on the first pattern detected at the detecting when forming an image that is to be transferred onto the recording medium;

second adjusting including performing a second adjustment of adjusting density of the colors other than black based on the second pattern detected at the detecting when forming an image that is to be transferred on the recording medium; and determining whether to perform the first adjustment or the second adjustment based on a type of an image to be formed on the recording medium, wherein when it is determined at the determining to perform the first adjustment, the first pattern is formed on the image carrier, and when it is determined at the determining to perform the second adjustment, the second pattern is formed on the image carrier, wherein the second pattern includes a plurality of patterns of respective colors other than black, and the forming includes forming the patterns of the colors other than black on the image carrier in parallel to each other in a sub-scanning direction of the image carrier.

9. The method according to claim 8, wherein when the image is a black image, the determining includes determining to perform the first adjustment.

10. The method according to claim 9, wherein when the image is a color image, the determining includes determining to perform the second adjustment.

11. The method according to claim 8, wherein the forming includes forming the first pattern on the image carrier by using a first image forming unit, and forming the second pattern on the image carrier by using a second image forming unit, the method further comprising contact determining including determining whether the second image forming unit is in contact with the image carrier, and the determining includes determining to perform the first adjustment when it is detected at the contact determining that the second image forming unit is not in contact with the image carrier, and to perform the second adjustment when it is detected at the contact determining that the second image forming unit is in contact with the image carrier.

12. The method according to claim 8, further comprising switching a print mode between a monochrome mode in which a black image is formed on the recording medium and a color mode in which a color image is formed on the recording medium, wherein the determining includes determining to perform the first adjustment when a current print mode is the monochrome mode, and to perform the second adjustment when the current print mode is the color mode.

13. The method according to claim 8, wherein a time for performing the first adjustment is shorter than a time for performing the second adjustment.

* * * * *